US009635933B2

(12) United States Patent
Rosing et al.

(10) Patent No.: US 9,635,933 B2
(45) Date of Patent: May 2, 2017

(54) OVERBED TABLE WITH FOLDABLE TOP

(71) Applicants: Howard S. Rosing, Naples, FL (US); Jonathan Liberty, Toronto (CA)

(72) Inventors: Howard S. Rosing, Naples, FL (US); Jonathan Liberty, Toronto (CA)

(73) Assignee: G-Tracking, LLC, Naples, FL (US)

( * ) Notice: Subject to any disclaimer, the term of this patent is extended or adjusted under 35 U.S.C. 154(b) by 180 days.

(21) Appl. No.: 14/656,055

(22) Filed: Mar. 12, 2015

(65) Prior Publication Data

US 2015/0257528 A1 Sep. 17, 2015

Related U.S. Application Data

(60) Provisional application No. 61/953,103, filed on Mar. 14, 2014.

(51) Int. Cl.

| | |
|---|---|
| ***A47B 23/00*** | (2006.01) |
| ***A47B 23/04*** | (2006.01) |
| *A47B 13/08* | (2006.01) |

(52) U.S. Cl.

CPC ..... *A47B 23/046* (2013.01); *A47B 13/088* (2013.01); *A47B 2023/047* (2013.01); *A47B 2200/0043* (2013.01)

(58) Field of Classification Search

CPC ..... A47B 23/02

USPC ..... 108/3, 6, 8, 39, 49, 50.01, 147

See application file for complete search history.

(56) References Cited

U.S. PATENT DOCUMENTS

| | | | | |
|---|---|---|---|---|
| 2,328,471 A * | 8/1943 | Leffel | A47B 27/00 108/23 |
| 3,954,315 A * | 5/1976 | Sanden | A47B 88/0477 312/333 |
| 5,100,090 A * | 3/1992 | Drower | A47B 96/027 108/152 |
| 6,113,205 A * | 9/2000 | Kuo | A47B 47/042 108/143 |
| 8,316,777 B1 * | 11/2012 | Rosing | A47B 23/046 108/49 |
| 2012/0199622 A1 * | 8/2012 | Palmer | A47B 23/043 224/577 |

* cited by examiner

*Primary Examiner* — Matthew Ing

(74) *Attorney, Agent, or Firm* — Cohena Grigsby, P.C.

(57) ABSTRACT

An overbed table wherein a flex top (40) is selectively coupled to a table top frame (38). Flex top (40) has fasteners (118, 120) that engage openings (114, 116) in the table top frame. Flex top (40) also includes pins (74, 76) that cooperate with stops (78, 80, 82, 84) that are defined in tracks (50, 52). When pins (74, 76) are seated on first stops (78, 80) flex top is planar. When pins (74, 76) are seated on other stops (82, 84) panels (54, 56) form a peak (86) that is ergonomically favored for certain activities and uses.

24 Claims, 10 Drawing Sheets

OVERBED TABLE WITH FOLDABLE TOP

BACKGROUND OF THE INVENTION

Field of the Invention

The presently disclosed invention relates to adjustable tables and, more particularly, tables that are ergonomically suitable for use in connection with beds, wheelchairs, patients' chairs and recliners such as used in hospitals and other health care institutions.

Discussion of the Prior Art

Adjustable tables have been used for many years for a variety of reasons and purposes. In the case where users are bedridden or have limited mobility such as patients in hospitals or nursing care facilities, such tables help provide meals and are otherwise useful in affording a platform for personal care. Such tables are also helpful in connection with the patient's pursuit of other activities such as reading or other enjoyments and interests.

Persons who are bedridden or have limited mobility have a limited range of motion and body positions available to them. If has been found that such limitations on range of motion or position can cause patient discomfort and, in some cases, can even be harmful to the patient. Accordingly, in health care setting and elsewhere, there has been increasing emphasis on beds and other furniture that is ergonomically suited to the user's needs With regard to overbed tables, there have been significant improvements to their ergonomic character. For example, U.S. Pat. No. 8,316,777 describes an overbed table with improved stability. In that case, the table was provided with arm supports suitable for use by patients whose injuries or disabilities required adjustable arm supports by which they could gain leverage to move themselves or to support others who may be assisting them. To improve the stability of the overbed, the position of the arm rests relative to the supporting platform for the table was redesigned. The redesign allowed significantly greater leverage to be brought against the arm rests without the risk that the table would pitch forward and result in frustration or even injury to the patient.

More recently, it has been recognized that overbed tables would be still further improved if they could better accommodate certain user activities. For example, when patients that participate in activities that involve very limited or highly repetitive movements or body positions such as reading, it would be preferable that the overbed table can accommodate the position that is most ergonomically favorable to them. It has been found that, in many cases, this involves an overbed table with capabilities for a foldable top surface. Particularly advantageous would be an overbed table that afforded a top surface that had a range of foldable positions as this would accommodate not only a number of activities, but also a variety of body types and sizes among those people who are engaging in such activities.

In addition to the forgoing, it also has been found that improved designs in overbed tables should also better accommodate the need for cleaning. It would be particularly beneficial if the design would enable easier, faster cleaning procedures. That would not only result in considerable costs savings, but would also tend to avoid resistance and objections to regular cleaning so as to result in cleaner, safer overbed tables.

SUMMARY OF THE INVENTION

In accordance with the presently disclosed invention, an overbed table includes a desktop body that is supported by at least one elongate member that is secured to a support platform. A flexible table top that is secured to the top of the desktop body includes a table top frame and a flex top. The table top frame is pivotally connected to the back of the desktop body so that the overbed table can be opened from the top for access to the desktop body by lifting the table top frame. In some cases, friction hinges are used to connect the table top frame to the desktop body so that the top will not close inadvertently.

A flex top that is connected to the table top frame includes two panels that are connected by an integrated hinge. The flex top includes pins that cooperate with stops that are configured along a track that is defined in the table top frame to control the position of the two flex top panels. In one position, the panels are in the same plane. When the pins of the flex top are moved to other stop positions in the track, the back of the flex top moves forward causing the two panels to form a peak along the axis of the integrated hinge that joins the panels. The rise in the peak is determined by the position of the pins in the track; the further forward the pins are moved, the steeper the peak that is formed by the two panels.

Preferably, the front of the flex top is connected to the front of the table top frame by a biased fastener that allows the front of the flex top to be manually uncoupled from the front of the table top frame. This allows the flex top to be pivoted away from the table top frame so that the bottom surface of the flex top can be cleaned quickly and easily.

Also preferably, the overbed table includes armrests that are connected to the desktop body by a slide assembly. The slide assembly includes a slide housing and a rail that cooperates with the slide housing and that is secured to the bottom of the armrest. The user can adjust to the position of the armrest relative to the position of the desktop body by pushing or pulling on the armrest to achieve the desired location. The slide housing is secured to the desktop body. Accordingly, the angular pitch of the armrest relative to the desktop body is determined by the orientation of the slide housing with respect to the desktop body.

In some cases, a gasket may be attached to the desktop body at a location between the desktop body and the bottom of the armrest. The gasket acts to seal fluids from traveling underneath the armrest to locations that are difficult to access for purposes of cleaning the overbed table.

It is sometimes preferable that the flex top includes third and fourth panels that are connected to the first and second panels by respective second and third integrated hinges. In that case, the third panel includes the biased fastener for coupling and uncoupling the front of the flex top to the front of the tale top frame and pins that cooperate with stops in the track extend from the fourth panel. In all cases, the integrated hinges provide a smooth, continuous surface on the top of the flex top so that there are no cracks or valleys between adjacent panels.

In some embodiments, the flex top includes border segments with a top surface that is at elevation that is higher than the top surface of the non-border portions of the flex top. The border segments in combination with the continuous top surface of the flex top across the integrated hinges allows liquids that may be spilled on the top surface of the flex top to be contained on the flex top thus avoiding liquids flowing from the overbed table unto bedding or elsewhere. Preferably, the top surface of the flex top is inclined downwardly in the direction of the user. One advantage of this is that spilled liquids will be pooled on the top surface of the flex top for easier and faster cleanup.

These and other objects, details and advantages of the presently disclosed overbed table will become better understood or apparent from the following descriptions and examples that are further disclosed herein.

BRIEF DESCRIPTION OF THE DRAWINGS

A presently preferred embodiment of the disclosed invention is shown and described in connection with the accompanying drawings wherein.

DESCRIPTION OF A PRESENTLY PREFERRED EMBODIMENT

Figure 1:
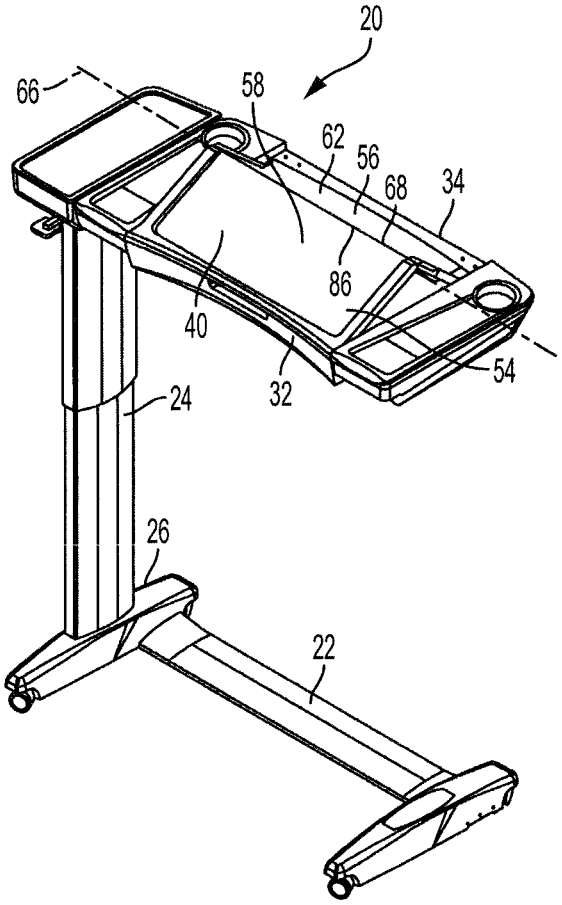
FIG. 1 is a projection of an embodiment of an overbed table showing a flexible table top in a folded position.
Figure 2:
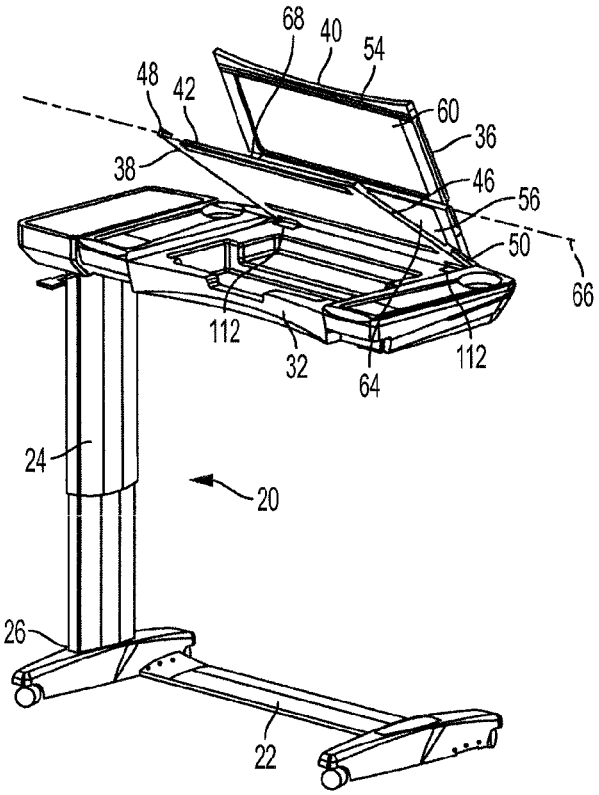
FIG. 2 is a projection of the overbed table of FIG. 1 with the flexible table top in a flat geometry and with a flexible table top opened from the desktop body.
Figure 3:
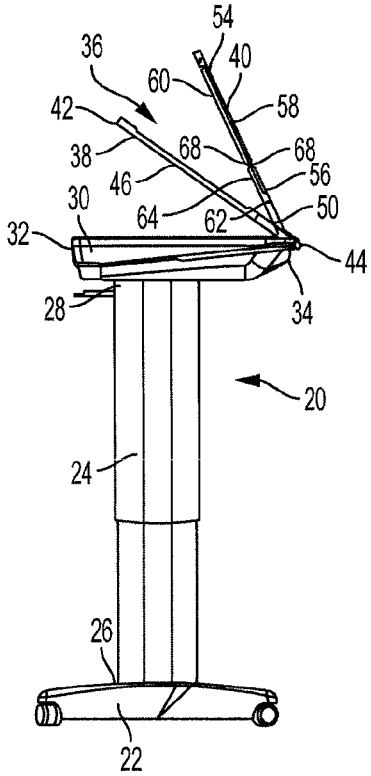
FIG. 3 is a side elevation of the overbed table shown in FIG. 2.

A presently preferred embodiment of an overbed table in accordance with the presently disclosed invention is shown and described in connection with FIGS. 1-13. With particular reference to FIGS. 1-3, an overbed table 20 includes a support platform 22 and an elongate member 24. Elongate member 24 includes a first end 26 that is connected to support platform 22 and a second end 28 that located oppositely on elongate member 24 from first end 26. Embodiments such as shown in FIGS. 1-3 with a single elongate member 24 are generally preferred by patients in hospital beds because the support platform 22 will fit under the patient's bed. In some embodiments, more than one elongate member 24 can be used in cooperation with support platform 22. In such cases, two or more elongate members 24 may provide appropriate support for patents in wheelchairs or recliners. For example, FIG. 4A shows an embodiment wherein two elongate members 24 are used to support the table from the support platform 22.

Overbed table further includes a desktop body 30 that is connected to the second end 28 of elongate member 24. As also shown in FIG. 4A, in some cases more than one elongate member can be connected to support platform 22 and to desktop body 30. Desktop body 30 defines a front side 32 and a back side 34. A flexible table top 36 includes a table top frame 38 and a flex top 40. Table top frame 38 defines a front edge 42 and a back edge 44. Table top frame 38 is pivotally connected to desktop body 30 adjacent to back side 34. Table top frame 38 defines two raised edges 46, 48 that are oriented in the direction between front edge 42 and back edge 44 of table top frame 38. Raised edges 46, 48 define respective tracks 50, 52 therein.

Flex top 40 includes first panel 54 and second panel 56. Panel 54 defines top surface 58 and bottom surface 60. Panel 56 defines top surface 62 and bottom surface 64. Panels 54 and 56 are pivotally connected together along a folding axis 66 by an integral hinge 68. Integral hinge 68 defines a continuous even surface 70 between top surface 58 of panel 54 and top surface 62 of panel 56. Integral hinge defines a groove 72 between the bottom surface 60 of panel 54 and bottom surface 64 of panel 56. Flex top 40 includes following members such as pins 74, 76 that extend through tracks 50 and 52 respectively.

At times when pins 74, 76 are at a first stop 78, 80 in tracks 50, 52 respectively, the top surfaces 58, 62 of panels 54, 56 define a planar surface. At times when pins 74, 76 are located at stops 82, 84 that are closer to front edge 42 of table top frame 38 than first stop 78, 80, panels 54 and 56 pivot to form a peak 86 therebetween along axis 66.

Details of support platform 22 are more particularly shown and described in connection with FIG. 4. Support platform 22 may include, for example, feet 88 that are mounted on casters 90 and joined by a base rail 92. Support platform 22 establishes a horizontal plane of support for the overbed table.

Figure 4:
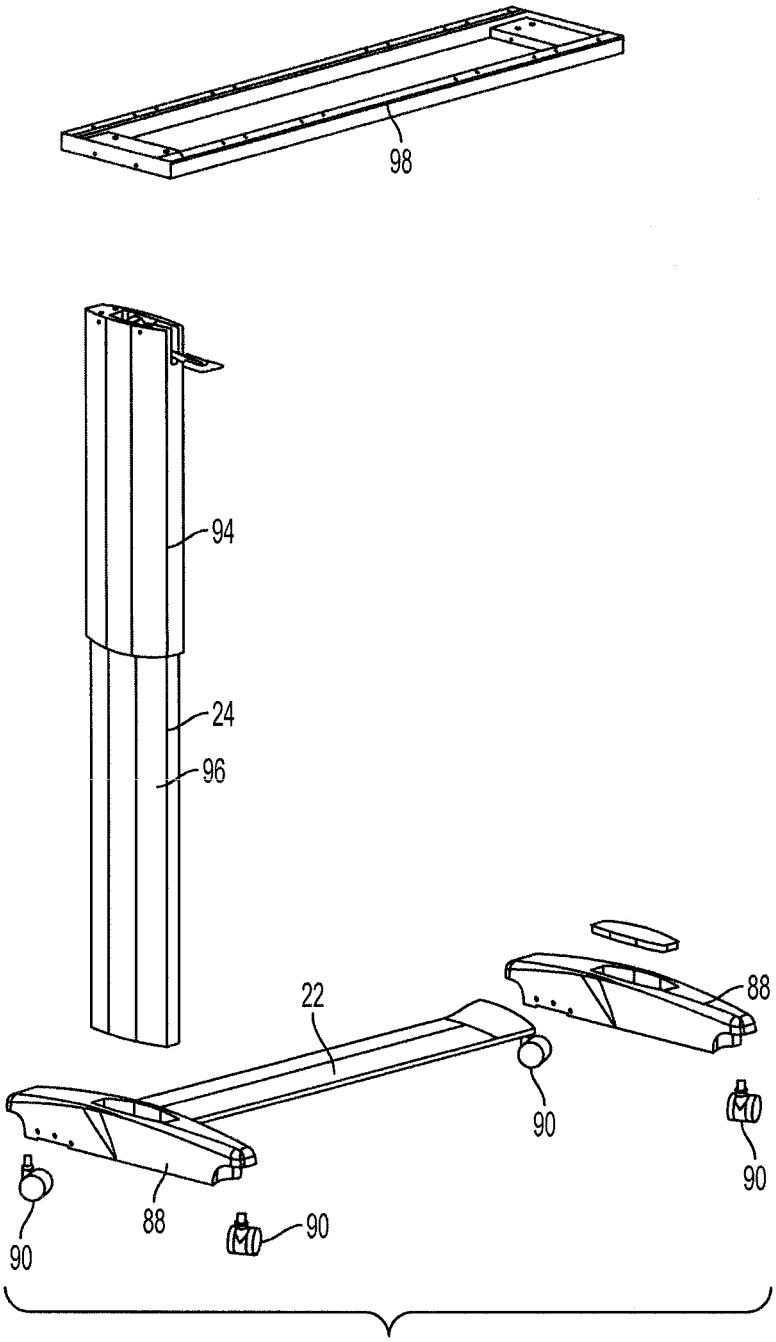
FIG. 4 is an exploded view of portions of the overbed table shown in FIGS. 1-3 wherein a single elongate member supports is connected between the support platform and the desktop body.
Figure 4A:
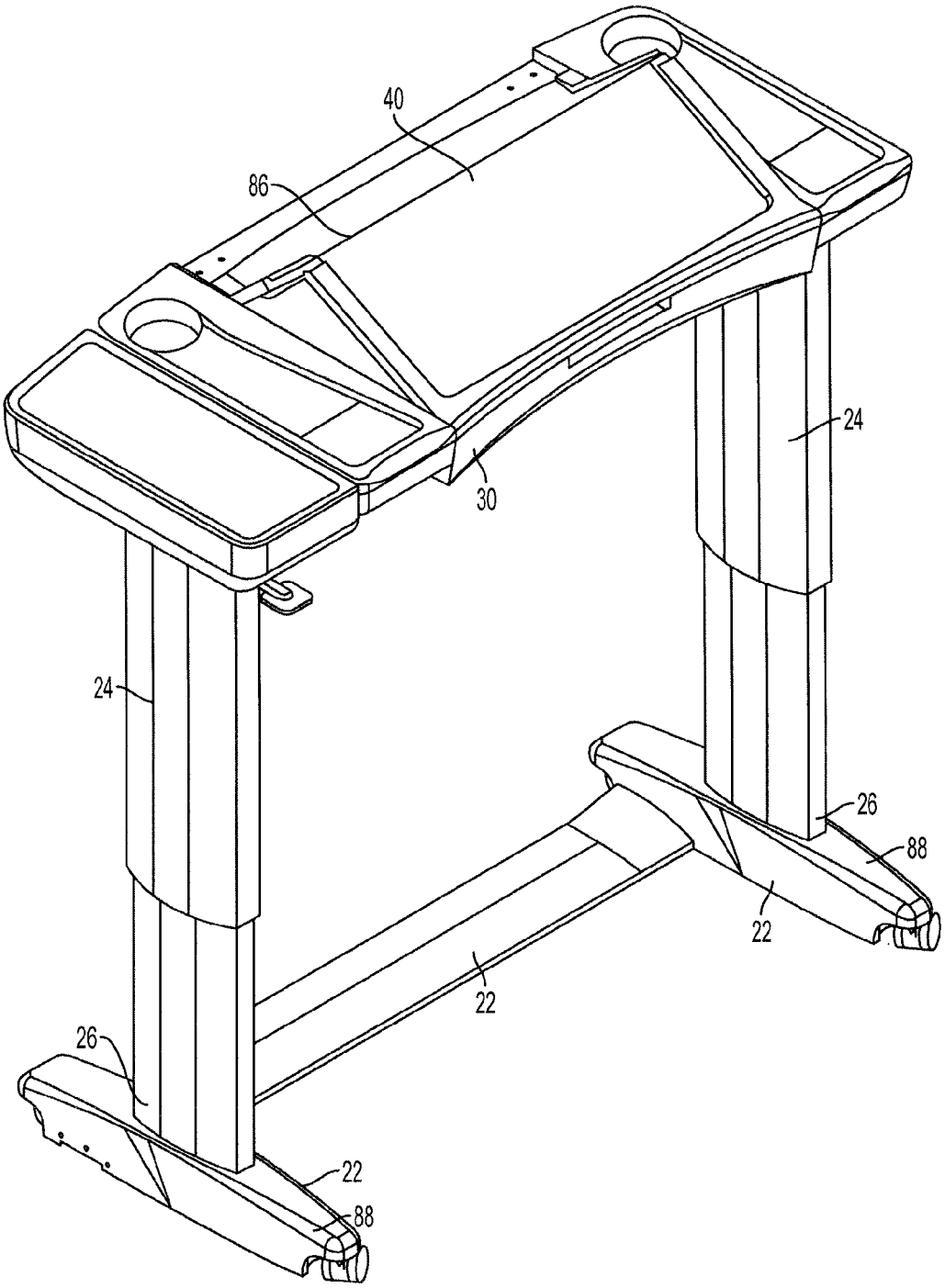
FIG. 4A is projection view of the overbed table shown in FIGS. 1-3 modified to show the use of two elongate members to support the desktop body.

FIG. 4 also shows that elongate member 24 extends from support platform 22 in a direction that is normal to the horizontal support plane established by support platform 22. In the embodiment of FIG. 4, elongate member 22 includes telescoping part 94, 96 such that length of elongate member 22 can be modified by moving telescoping parts 94, 96 with respect to each other in the longitudinal direction.

Figure 5:
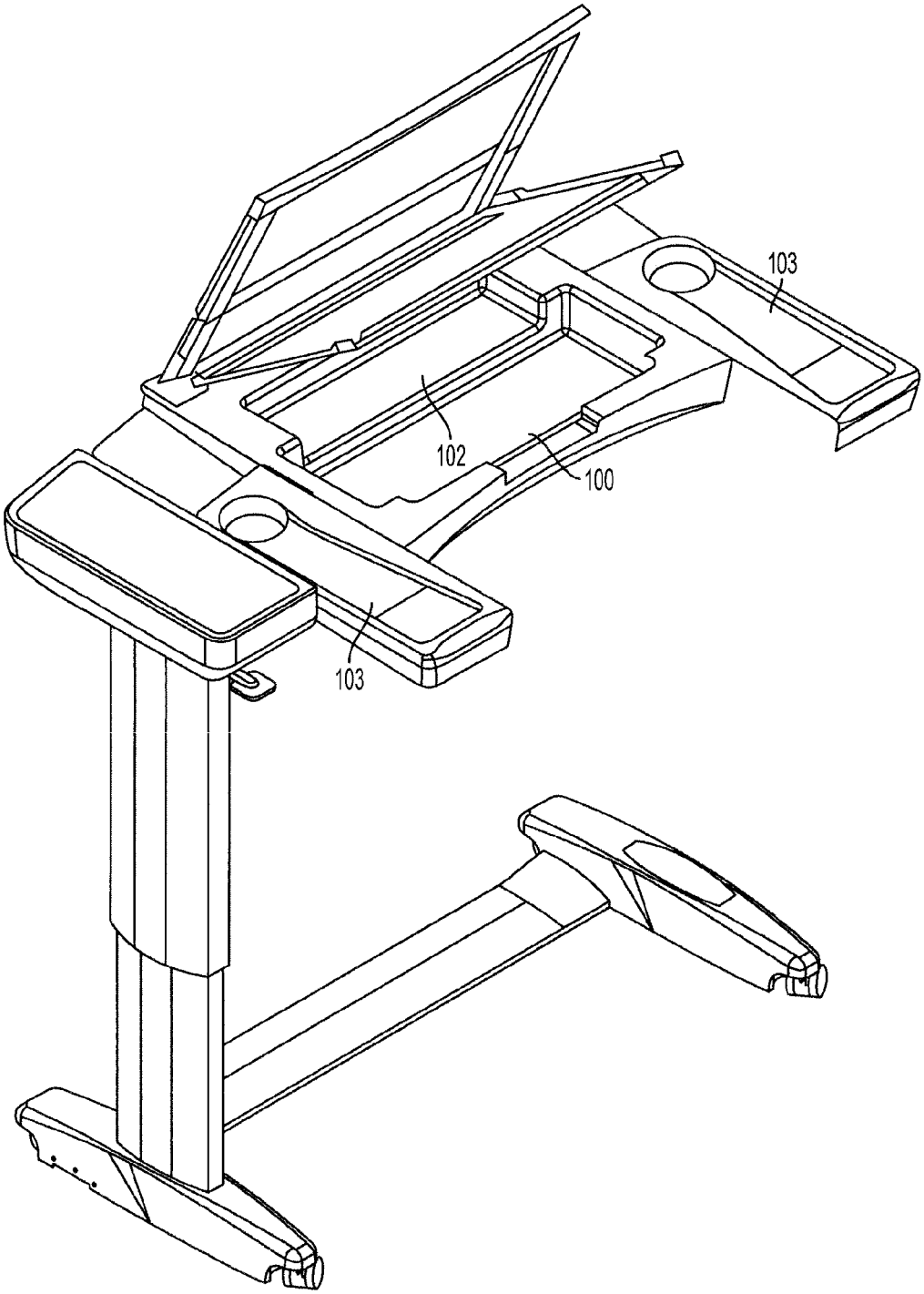
FIG. 5 is a projection of the embodiment of the overbed table shown in FIGS. 1-4 with the armrests displayed in an extended position.
Figure 6:
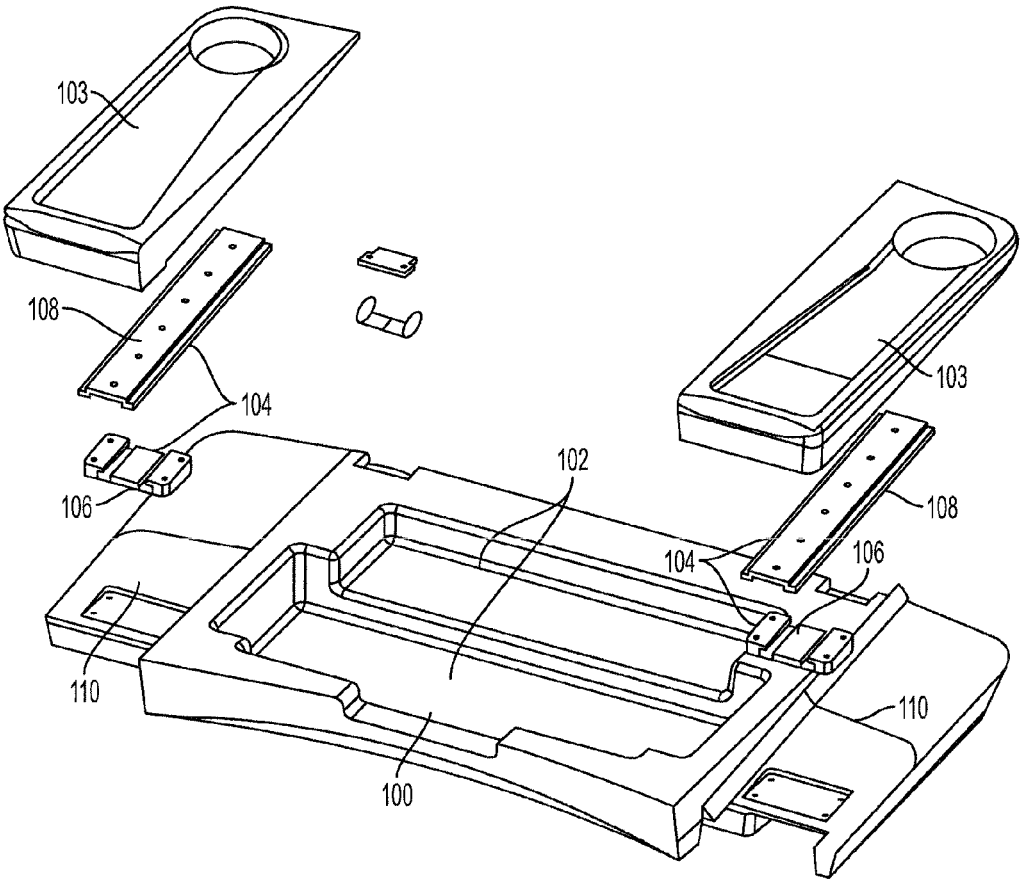
FIG. 6 is an exploded view of portions of the overbed table shown in FIGS. 1-5 showing the shell of the desktop body together with the armrests and slide assembly.

As shown in FIGS. 4-6, in the preferred embodiment of the disclosure, a desktop body 30 includes a frame 98 that is fastened to second end 28 of elongate member 24 and a shell 100 that is fastened to frame 98. Shell 100 may be a molded body of the type that defines compartments 102 therein.

Figure 7:
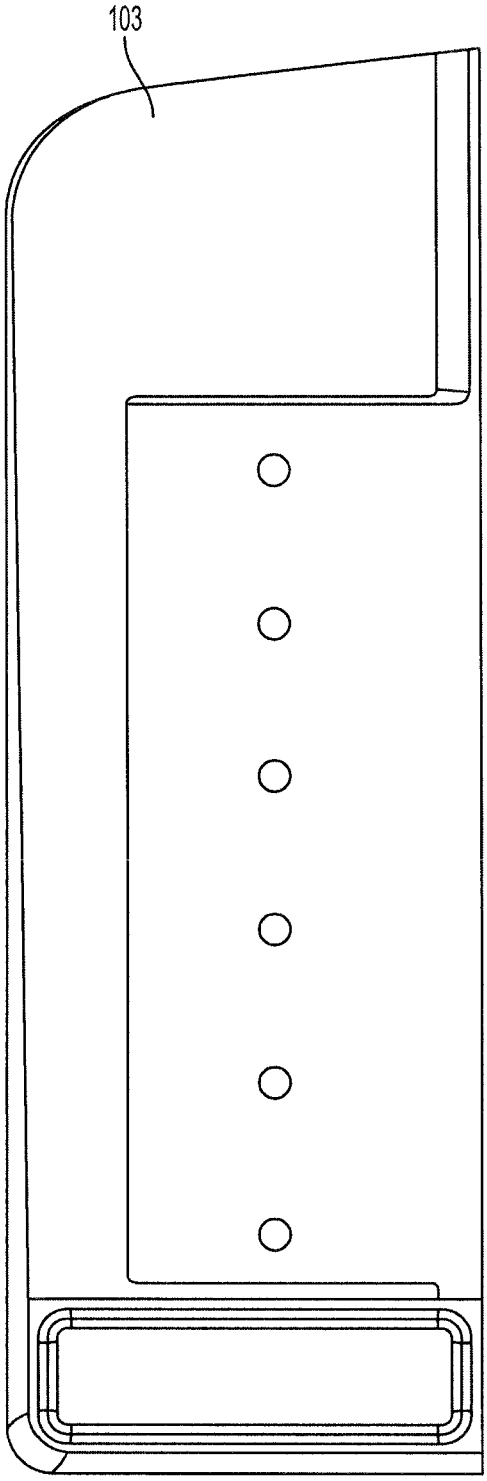
FIG. 7 is a bottom view of the armrests that are shown in FIGS. 1-3, 5 and 6.

Referring to FIGS. 5-7, the disclosed overbed table further includes a armrests 103 that are secured to desktop body 30 by slide assembly 104. Slide assembly 104 includes a slide housing 106 that is fastened to desktop body 30 and a rail 108 that is slidingly engaged in slide housing 106. Rail 104 is moveable within slide housing 106 and slide housing 106 is oriented on shell 100 of desktop body 30 such that rail 104 is moveable in the direction toward and away from front side 32 of said desktop body 30.

Armrests 103 are secured to respective rails 108 of corresponding slide assemblies 104. Armrests 103 are moveable together with rail 108 so that the position of armrests is easily adjusted by the user.

FIG. 5 shows armrests 103 in an extended position and FIGS. 1-3 shows armrests 103 in a retracted position. From this it can be appreciated that slide assembly 104 is oriented with respect to shell 100 and desktop body 30 such that the movement of armrest 103 in the direction from the back side 34 of desktop body 30 toward front side 32 of desktop body 30 is inclined downwardly with respect to said desktop body. The particular pitch or degree of downward incline is determined according to the orientation of slide housing 104 as secured to shell 100.

In some embodiments, the disclosed overbed table includes a desktop body 30 wherein the shell 100 includes a gasket that is located on shell 100 of desktop body 30. Gasket 110 is positioned between shell 100 of desktop body 30 and armrest 103 to seal against fluid flow between desktop body 30 and the underside of armrest 103. Gasket 110 thus seals against the flow of fluids that may be spilled on or around shell 100 and flow to parts of the overbed table that would be more difficult and expensive to clean.

FIGS. 2, 3, 5 and 6 show that table top frame 38 of flexible table top 36 is pivotally connected to desktop body 30 by hinges 112. Hinges 112 are secured adjacent back edge 44 of table top frame 38 and are also secured adjacent back side 34 of desktop body 30. In this way, the user can access shell 100 and compartments 102 by raising the front of table top frame 38 to expose shell 100. To avoid inadvertent closing of table top frame 38, hinges 112 may be friction hinges.

Figure 9:
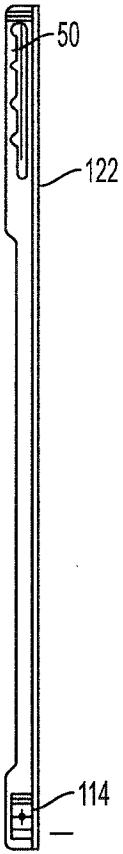
FIG. 9 is a side elevation view of the table top frame that is shown in FIG. 8.
Figure 8:
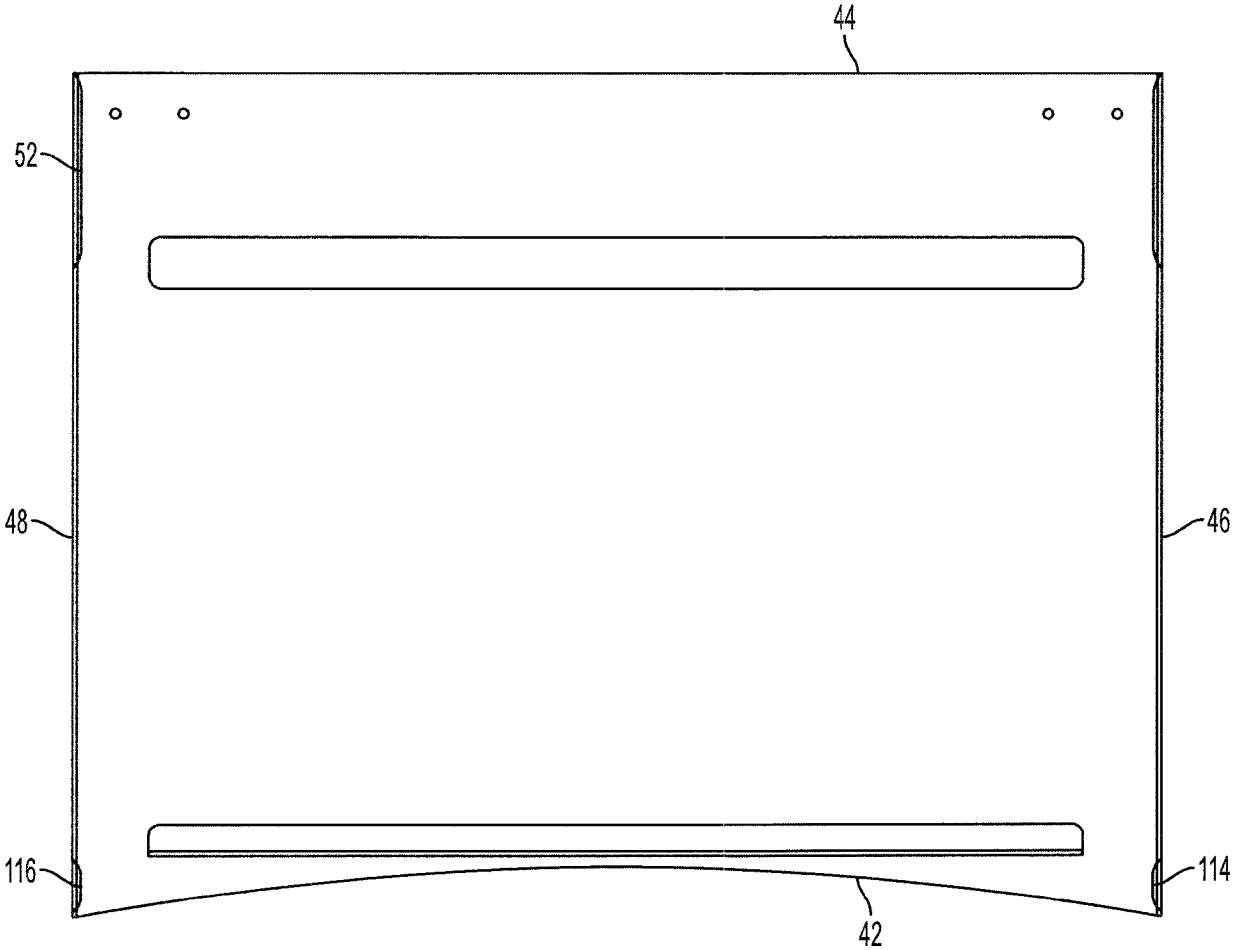
FIG. 8 is a top plan view of the table top frame that is included in FIGS. 1-3 and 5.
Figure 13:
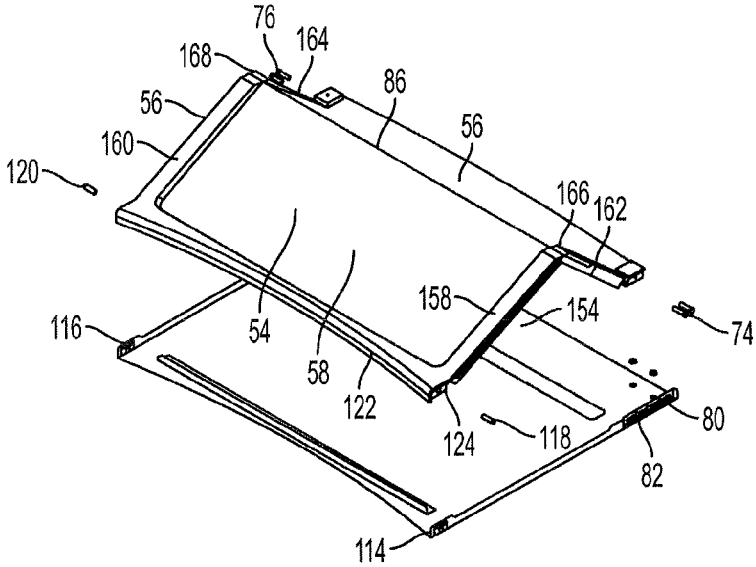
FIG. 13 is an exploded view of the table top frame and the flex top that are shown in FIGS. 1-3, 5 and 8-12.

FIGS. 8, 9 and 13 show table top frame 38 wherein raised edges 46, 48 further define openings 114, 116 that are located in raised edges 46, 48 respectively. Openings 114, 116 are located between respective track 50, 52 of edges 46, 48 and front edge 42 of table top frame 38. Correspondingly, flex top 40 includes fasteners 118, 120 that are extendable through openings 114, 116 of raised edges 46, 48 at times when fasteners 118, 120 are respectively aligned with openings 114, 116. In this way, flex top 40 is connected to table top frame 38, preferably at a location near the front edge 42 of table top frame 38. Fasteners 118, 120 are retractable in the longitudinal direction of the fasteners such that they are moveable out of openings 114, 116 to uncouple the front of flex top 40 from table top frame 38 thereby leaving flex top 40 pivotally connected to table top frame 38 by pins 74, 76 at times when fasteners 118, 120 are out of opening 114, 116.

In the presently preferred embodiment, fasteners 118, 120 are normally biased to extend through openings 114, 116 at times when the fasteners are respectively aligned with the openings. Fasteners 118, 120 may be of the type that they can be manually displaced from openings 114, 116. Is some embodiments, fasteners 118, 120 may be spring plungers.

FIGS. 8, 9 and 13 also show that tracks 50, 52 of table top frame 38 define one or more stops 82, 84 that are located at respective positions along tracks 50, 52 respectively, Stops 82, 84 are configured to allow respective pins 74, 76 to travel along the respective track 50, 52 past stops 82, 84. At the same time, stops 82, 84 also provide a seat for maintaining pins 74, 76 at the position of a selected stop 82, 84 as the user of the overbed table may elect. The user may bypass stops 82, 84 by moving pins 74, 76 over or around the stops. The user may engage pins 74, 76 with stops 82, 84 by positioning the pins against a selected stop.

In the presently preferred embodiment, FIGS. 1-3, 5 and 10-13 show that flex top 40 includes a third panel 122 that is connected to first panel 54 by a second integral hinge 124. Third panel 122 has a side 126 that is located on third panel 122 oppositely from second integral hinge 124. Side 126 defines a concave edge to allow the user closer access to flex top 40. Third panel 122 further defines first and second edges 128, 130 that are oppositely disposed on third panel 122 from each other.

At times when fasteners 118, 120 are in their normally biased state, the fasteners extend from first and second edges 128, 130 respectively. To remove fasteners 118, 120 from openings 114, 116 respectively, the user manually presses inwardly against the ends of fasteners 118, 120 in the longitudinal direction to overcome the bias force of fasteners 118, 120 and push the respective ends of the fasteners out of openings 114, 116. Flex top 40 is then pivotally connected to fable top frame 38 by pins 74, 76 such that flex top 40 be pivoted upwardly from the front edge 42 to afford access to the bottom of flex top 40 so that it can be quickly and easily cleaned.

Also shown in FIGS. 1-3, 5 and 10-13, the preferred embodiment of flex top 40 may include a fourth panel 132 that is connected to second panel 56 by a third integral hinge 134. Fourth panel 132 defines a side 136 that is located oppositely on said fourth panel 132 from third integral hinge 134. Also, fourth panel 132 defines first and second edges 138, 140 that are oppositely disposed on fourth panel 132 from each other. Pins 74, 76 extend from first and second edges 138, 140 respectively.

In the operation of flex top 40, starting with fasteners 118, 120 engaged in openings 114, 116 and pins 74, 76 engaged with the first stops 78, 80 respectively, the flex top 40 has a planar geometry that is essentially parallel to the plane of table top frame 38. To form the folded top feature of the disclosed overbed table as shown in FIGS. 1 and 13, pins 74, 76 are moved from first stops 78, 80 and urged forward through tracks 50, 52 to a selected one of stops 82, 84. This movement causes first panel 54 to cooperate with second panel 56 to form a peak 86 along folding axis 66. The steepness of the peak 86 depends on the stop 82, 84 that the user, in their own discretion, selects. The closer the stop 82, 84 to side 126 of flex top 40, the steeper the peak that is formed.

Figure 10:
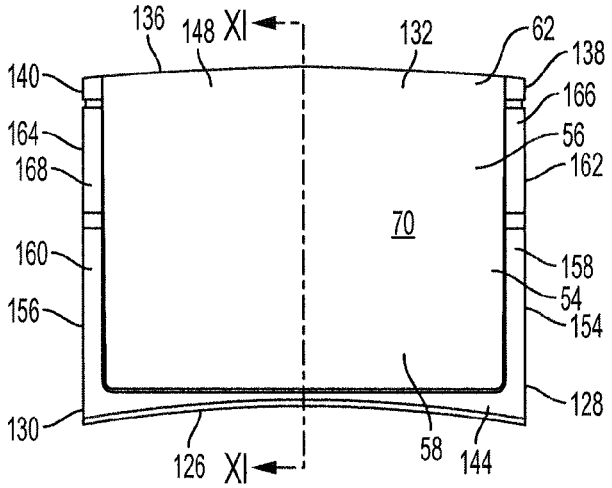
FIG. 10 is a top plan view of the flex top that is shown in FIGS. 1-3 and 5.
Figure 11:
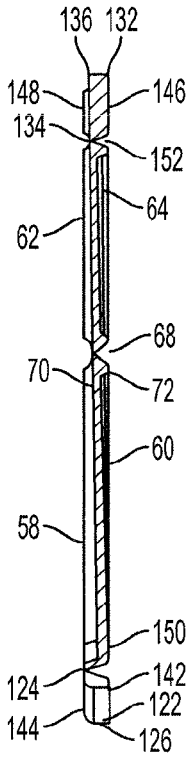
FIG. 11 is a cross-section of the flex top shown in FIG. 10 taken along the lines XI-XI of FIG. 10.
Figure 12:
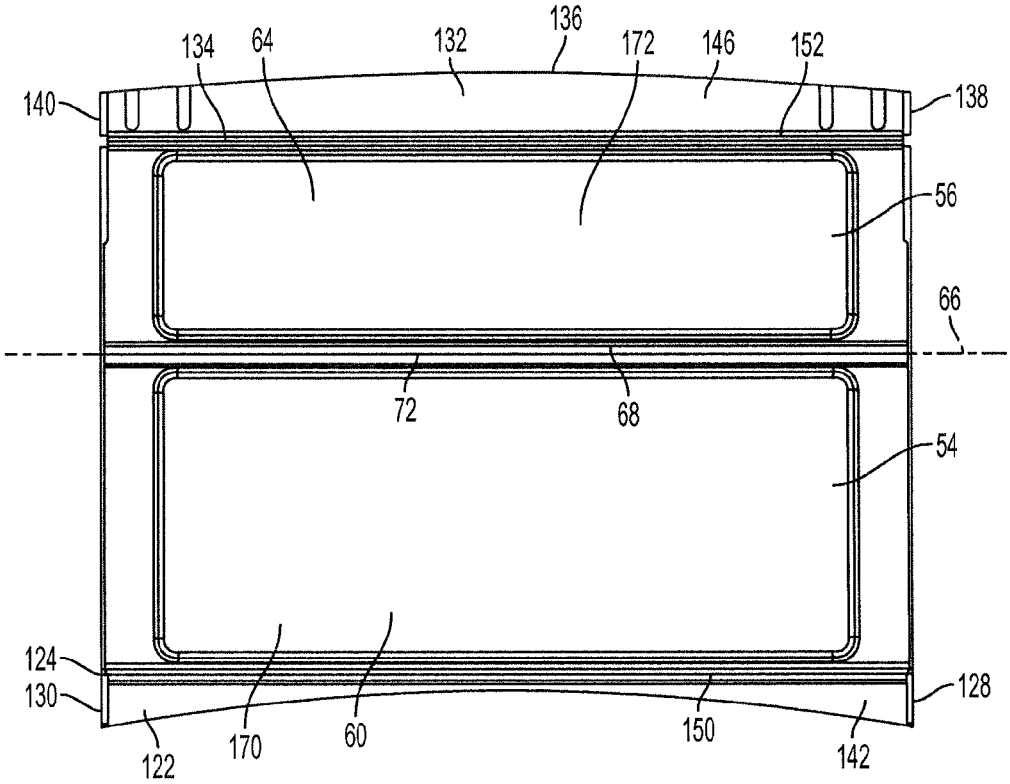
FIG. 12 is a bottom plan view of the flex top that is shown in FIGS. 10 and 11.

FIGS. 10-12 show that third panel 122 defines a bottom surface 142 and a top surface 144 that is oppositely disposed on the third panel from the bottom surface. Second integral hinge 124 defines a continuous, even surface between top surface 58 of first panel 54 and top surface 144 of third panel 122. Similarly, fourth panel 132 defines a bottom surface 146 and a top surface 148 that is oppositely disposed on fourth panel 132 from bottom surface 146. Third integral hinge 134 defines a continuous, even surface between top surface 62 of second panel 56 and top surface 148 of fourth panel 132.

As shown in the drawings, second integral hinge 124 defines a groove 150 between bottom surface 60 of first panel 54 and bottom surface 142 of third panel 122. Similarly, third integral hinge 134 defines a groove 152 between bottom surface 64 of second panel 56 and bottom surface 146 of fourth panel 132.

As particularly shown in FIGS. 1-3 and 10-13, at times when flex top 40 is in a folded position, top surface 58 and top surface 144 define an included angle that is less than 180 degrees and top surface 62 and top surface 148 also define an included angle that is less than 180 degrees. At the same time, the angle between top surface 54 and top surface 62 when flex top 40 is in a folded position is greater than 180 degrees. Nevertheless, grooves 72, 150 and 152 are all on the bottom side of flex top 40. In this way, the top surface of flex top 40 that is formed by the top surfaces 58, 62, 144 and 148 in combination with integral hinges 68, 124 and 134 forms a continuous, even, integral surface. The top surface of flex top 40 thus formed is without cracks or separations between panels 54, 56, 122 and 132 that could result in discontinuities between adjacent panels. Such features are potential sources for leakage of fluids spilled on flex top 40 or ridges that interfere with certain user activities such as writing as well as other annoyances and inconveniences. In this way, the integral surface of flex top 40 provides an overbed table that is easier to clean and less prone to penetration of fluids, dust and other contaminants that make cleaning the overbed table difficult and costly.

As also shown in the drawings, first panel 54 defines a first edge 154 and a second edge 156 that is oppositely disposed on first panel 54 from first edge 154. The top surface 58 of panel 54 of flex top 40 defines a first border segment 158 and a second border segment 160. Border segments 158 and 160 are adjacent first and second edges 154, 156 respectively of first panel 54. The top surface of first and second border segments 158, 160 of first panel 54 are elevated from the top surface 58 of the portion of first panel 54 that is between first and second border segments 158, 160. Also, top surface 58 of the portion of first panel 54 that is between first and second border segments 158, 160 is inclined with respect to the top surface of border segments 158, 160. The sense of the incline across the top surface is downwardly in the direction from first integral hinge 68 toward the concave side 126 of flex top 40.

Similarly to the top surface of first panel 54, second panel 56 defines a first edge 162 and a second edge 164 that is oppositely disposed on second panel 56 from first edge 162. The top surface of second panel 56 of flex top 40 defines a first border segment 166 and a second border segment 168. First and second border segments 166, 168 are adjacent first and second edges 162, 164 of second panel 56. The top surface of first and second border segments 166, 168 of second panel 56 are elevated above the top surface 62 of the portion of second panel 56 that is between first and second border segments 166, 168. The top surface of the portion of second panel 56 between first and second border segments 166, 168 is also inclined with respect to the top surface of first and second border segments 166, 168. The sense of the incline across the top surface is downwardly in the direction from side 136 of flex top 40 toward first integral hinge 68.

The structure of first and second border segments 158 and 160 in combination with first and second border segments 166, 168 together with inclined portions of the top surfaces 58 and 62 between those border segments causes fluids that may be spilled on top surfaces 58, 62 of panels 54, 56 to pool on the top surface of flex top 40 near the concave side 126 of third panel 122. Thus, here again the disclosed overbed table provides for quick and easy cleanup of spilled liquids.

To save on material costs to reduce the weight of first panel 54 and second panel 56, the bottom surface 60 of first panel 54 defines a recessed area 170 between first and second edges 154, 156 of the first panel. Similarly, the bottom surface 62 of second panel 56 defines a recessed area 172 between first and second edges 162, 164 of second panel 56. This reduction in weight helps to make operation of the flex top easier.

While certain presently preferred embodiments of the disclosed invention have been shown and described herein, the scope of the invention is not limited thereto, but can be otherwise embodied in the following claims.

We claim:

1. An overbed table comprising:

a support platform;

at least one elongate member having first and second ends with said first end of said at least one elongate member being secured to said support platform and extending from said support platform;

a desktop body that defines a front side and a back side, said desktop body being connected to the second end of said at least one elongate member; and a flexible table top that includes:

a table top frame that defines a front edge and a back edge, said table top frame being pivotally connected to said desktop body adjacent to said back side of said desktop body, said table top frame defining at least one raised edge that is oriented in the direction between the front edge and the back edge of said table top frame, said raised edges defining at least one track therein and also defining openings that are located in the raised edges between the track of said edges and the front edge of said table to frame; and a flex top that includes at least first and second panels that define respective top and bottom surfaces, said first and second panels being pivotally connected together along a folding axis by an integral hinge, said integral hinge defining a continuous even surface between the top surfaces of said two panels and defining a groove between the bottom surfaces of said two panels, said flex top also including at least one following member that extends through said at least one track of said at least one raised edge of said table top frame such that the top of said first and second panels defines a planar surface at times when said following member is at a first position in said track and the top of said two panels defines a peak along said folding axis at times when said following member is at a second position in said track; said flex top further including a fastener that is moveable to extend through the openings of said raised edge to connect the flex top to said table top frame, said fastener also being moveable out of the opening of said raised edge such that said flex top is pivotally connected to said table top frame by said follower at times when said fastener is out of the opening of said raised edge.

2. The overbed table of claim 1 wherein said support platform establishes support in a horizontal plane and wherein said at least one elongate member extends from said support platform in a direction that is normal to said horizontal plane.

3. The overbed table of claim 1 wherein said desktop body includes a frame that is fastened to the second end of said at least one elongate member and a shell that is fastened to said frame, said shell defining compartments therein.

4. The overbed of claim 1 wherein said at least one elongate member includes telescoping parts such that length of said at least one elongate member can be modified by moving said telescoping parts with respect to each other in the longitudinal direction.

5. The overbed table of claim 1 further comprising:

a. A slide assembly that secured to said desktop body, said slide assembly including a slide housing that is fastened to said desktop body and a rail that is slidingly engaged in said slide housing such that said rail is moveable toward and away from the front side of said desktop body; and b. An armrest that is secured to the rail of said slide assembly and is movable together with said rail.

6. The overbed table of claim 5 wherein said desktop body further includes a gasket that is located on said desktop body, said gasket being positioned between said desktop body and said armrest to seal against fluid flow between said desktop body and said armrest.

7. The overbed table of claim 5 wherein said slide assembly is oriented with respect to said desktop body such that the movement of said armrest in the direction from the back side of said desktop body toward the front side of said desk top body is inclined downwardly with respect to said desktop body.

8. The overbed of claim 1 wherein the table top frame of said flexible table top is pivotally connected to the desktop body by hinges that are secured adjacent the back edge of said table top frame and that are also secured adjacent the back side of said desktop body.

9. The overbed of claim 8 wherein said hinges are friction hinges.

10. The overbed table of claim 1 wherein said fastener is normally biased to extend through said openings at times when said fastener is aligned with said openings and wherein said fastener is manually displaced from the openings of said table top frame to make the flex top pivotally connected to said table top frame.

11. The overbed table of claim 10 wherein said fastener is a spring plunger.

12. The overbed table of claim 1 wherein the track of said table top frame defines one or more stops that are located at respective positions along said track, said stops being configured to allow said following member to travel along said track past said stops and also providing a seat for maintaining said following member at the position of a selected stop.

13. The overbed table of claim 12 wherein said flex top includes a third panel that is connected to said first panel of said flex top by a second integral hinge, said third panel having a side that is located oppositely from said second integral hinge with said side defining a concave edge.

14. The overbed table of claim 12 wherein said flex top includes a third panel that is connected to said first panel of said flex top by a second integral hinge, said third panel having a side that is located oppositely from said second integral hinge, said third panel also having first and second edges that are oppositely disposed on said third panel from each other, said fastener extending from at least one of said first and second edges.

15. The overbed of claim 14 wherein said flex top includes a fourth panel that is connected to the other of said first or second panels of said flex top by a third integral hinge, said fourth panel having a side that is located oppositely from said third integral hinge, said fourth panel also having first and second edges that are oppositely disposed on said fourth panel from each other, said following member extending from at least one of said first and second edges.

16. The overbed of claim 15 wherein said fourth panel defines a bottom surface and a top surface that is oppositely disposed on said fourth panel from said bottom surface, said third integral hinge defining a continuous, even surface between the top surface of said second panel and the top surface of said fourth panel.

17. The overbed of claim 16 wherein said third integral hinge defines a groove between the bottom surface of said second panel and the bottom surface of said fourth panel.

18. The overbed of claim 14 wherein said third panel defines a bottom surface and a top surface that is oppositely disposed on said third panel from said bottom surface, said second integral hinge defining a continuous, even surface between the top surface of said first panel and the top surface of said third panel.

19. The overbed of claim 18 wherein said second integral hinge defines a groove between the bottom surface of said first panel and the bottom surface of said third panel.

20. The overbed of claim 14 wherein said fastener extends from at least one of said first and second edges of said third panel at times when said fastener is in its normally biased state.

21. The overbed of claim 1 wherein said first panel defines first and second edges that are oppositely disposed on said first panel from each other, and wherein the top surface of said flex top defines first and second border segments that are adjacent the first and second edges of said first panel, the top surface of the first and second border segments of said first panel being elevated from the top surface of the portion of said first panel that is between said first and second border segments, the top surface of the portion of said first panel between said first and second border segments also being inclined with respect to the top surface of said border segments, with the sense of said incline being downwardly in the direction from said first integral hinge toward the front edge of said flex top.

22. The overbed of claim 21 said second panel defines first and second edges that are oppositely disposed on said second panel from each other, and wherein top surface of said the flex top defines first and second border segments that are adjacent the first and second edges of said second panel, the top surface of said first and second border segments of said second panel being elevated from the top surface of the portion of said second panel that is between said first and second border segments, the top surface of the portion of said second panel between said first and second border segments also being inclined with respect to the top surface of said border segments, with the sense of such incline being downwardly in the direction from said back edge of said flex top toward said first integral hinge.

23. The overbed of claim 21 wherein the bottom surface of said first panel defines a recessed area between the first and second edges of said first panel.

24. The overbed of claim 22 wherein the bottom surface of said second panel defines a recessed area between the first and second edges of said second panel.

* * * * *